US009669431B2

(12) United States Patent
Wollschlager

(10) Patent No.: US 9,669,431 B2
(45) Date of Patent: Jun. 6, 2017

(54) COMPOSTABLE ORGANIC WASTE COLLECTION METHOD AND MATERIALS

(71) Applicant: Randy's Sanitation, Inc., Delano, MN (US)

(72) Inventor: Jim Wollschlager, Delano, MN (US)

(73) Assignee: ORGANIX SOLUTIONS, LLC, Delano, MN (US)

( * ) Notice: Subject to any disclaimer, the term of this patent is extended or adjusted under 35 U.S.C. 154(b) by 232 days.

(21) Appl. No.: 13/723,622

(22) Filed: Dec. 21, 2012

(65) Prior Publication Data

US 2013/0168299 A1 Jul. 4, 2013

Related U.S. Application Data

(60) Provisional application No. 61/580,747, filed on Dec. 28, 2011.

(51) Int. Cl.
*B07C 5/00* (2006.01)

(52) U.S. Cl.
CPC ..... *B07C 5/00* (2013.01)

(58) Field of Classification Search
CPC .. B65D 25/14; B07C 5/00; B07C 5/34; B65F 3/00; B65F 1/06; B65F 1/068; B65F 1/12; B65F 1/122; B65F 1/1415
USPC ..... 209/3, 3.3, 546, 583, 930; 220/495.6
See application file for complete search history.

(56) References Cited

U.S. PATENT DOCUMENTS 4,185,731 A * 1/1980 Van Drie ..... B65G 65/06 198/304
5,100,005 A * 3/1992 Noble ..... B07C 5/34 206/459.5
5,251,761 A * 10/1993 Hansen ..... B65F 1/00 100/35
5,628,413 A 5/1997 Lu et al.
5,947,256 A 9/1999 Patterson
5,960,402 A 9/1999 Embutsu et al.
6,364,147 B1 * 4/2002 Meinzinger ..... B65F 1/06 126/243
7,032,820 B2 4/2006 Kreiner et al.
7,034,649 B2 4/2006 Asakura et al.
7,299,982 B2 11/2007 Kreiner et al.
7,660,724 B2 * 2/2010 Mallett ..... B07C 5/3412 206/366
8,109,409 B1 * 2/2012 MacMurray ..... A61L 2/22 220/495.01
8,266,739 B2 * 9/2012 Schaaf ..... A47K 11/02 232/43.1
8,459,461 B2 6/2013 Borowski et al.
8,550,252 B2 * 10/2013 Borowski ..... G06Q 99/00 209/3
8,567,675 B2 10/2013 Kreiner et al.
9,098,884 B2 8/2015 Borowski et al.
2006/0151497 A1 * 7/2006 Underwood ..... B65F 1/006 220/200
2006/0261163 A1 11/2006 Kokuryo et al.
(Continued)

*Primary Examiner* — Terrell Matthews
(74) *Attorney, Agent, or Firm* — Dorsey & Whitney LLP; Bridget M. Hayden

(57) ABSTRACT

A method of collecting and processing organic waste material is disclosed, comprising, placing organic waste in an identifiable can liner, placing the can liner in a general waste stream, and at a later point in time removing the can liner from the waste stream while maintaining the integrity of the contents therein.

8 Claims, 1 Drawing Sheet

(56) References Cited

U.S. PATENT DOCUMENTS

| | | | | |
|---|---|---|---|---|
| 2008/0050273 | A1* | 2/2008 | Agblevor | A01K 1/0152 422/5 |
| 2008/0197055 | A1* | 8/2008 | Mallett | B07C 5/3412 209/524 |
| 2009/0242567 | A1* | 10/2009 | Forbes | B65F 1/0006 220/495.08 |
| 2009/0317022 | A1* | 12/2009 | MacKay | B65D 25/16 383/71 |
| 2011/0133893 | A1 | 6/2011 | Only A Chief | |
| 2011/0238598 | A1* | 9/2011 | Borowski | G06Q 99/00 705/500 |
| 2013/0168299 | A1* | 7/2013 | Wollschlager | B07C 5/00 209/546 |
| 2015/0324760 | A1 | 11/2015 | Borowski et al. | |

* cited by examiner

COMPOSTABLE ORGANIC WASTE COLLECTION METHOD AND MATERIALS

RELATED APPLICATIONS

The present application claims priority to, and incorporates by reference, U.S. Provisional Patent Application No. 61/580,747 filed Dec. 28, 2011.

FIELD OF THE INVENTION

The present invention relates generally to organic material recycling, more particularly, the present invention relates to a method and material for use in separating, processing, sorting, and recycling organic materials from a refuse stream.

BACKGROUND OF THE INVENTION

Presently the refuse removal industry is in the midst of a revolution. The industry, which in the past, has been consumed merely with efforts to remove waste and refuse, is becoming increasingly focused on waste and refuse processing in an effort to alleviate the problems associated with landfills and to reduce the environmental impact of waste production through recycling and reuse programs.

Landfills are rapidly filling up as the amount of waste and refuse generated continues to increase. Presently, according to one estimate, the average American produces about 1,600 pounds of waste a year (about 4.4 pounds every day), which works out to approximately 240 million tons of waste a year nationwide. This does not account for industrial or commercial waste, and Americans are not even the world's largest per capita producers of waste. The problems of storing all this waste are acute and endemic.

Reducing the need and reliance on landfills serves a number of purposes. It reduces the likelihood of environmental problems, reduces the demand on space, not to mention the fact that landfills make very unpopular neighbors and consequently new landfills are very difficult to build. Landfills, however, cannot be eliminated. Thus, one of the best and most viable solutions is to reduce the amount of waste and refuse that reaches the landfill.

A number of prior art solutions to this problem have been tried, with some success, but also with substantial drawbacks. In particular, recycling programs have been used to separate certain materials from the waste stream that use to be routinely deposited in landfills. Most commonly, recycling programs can reclaim many types of plastics, glass, and paper products. Furthermore, in many locations programs have been established to remove environmentally sensitive products from the general waste stream, such as paints and solvents, automotive wastes (used motor oil, antifreeze, etc.), pesticides (insecticides, herbicides, fungicides, etc.), mercury-containing wastes (thermometers, switches, fluorescent lighting, etc.), electronics (computers, televisions, cell phones), aerosols/propane cylinders, caustics/cleaning agents, refrigerant-containing appliances, some specialty batteries (e.g. lithium, nickel cadmium, or button cell batteries), and ammunition. These items generally can no longer be disposed of through common curbside waste collection and must be taken to specialized disposal sites. Another example of materials that are frequently separated includes compostable material such as yard waste and organics such as food scraps and food-soiled paper products.

The foregoing represents a large percentage of overall waste, and separating these products from the waste stream has certainly produced environmental advantages as well as substantially reduced the amount of material deposited in landfills, however, this result has not been achieved without drawbacks and disadvantages.

In particular, separating the waste streams generally has been accomplished by creating wholly independent collection streams. Hazardous waste is no longer handled through curbside waste removal, and must be taken to a number of different facilities for processing and disposal. Similarly, recyclables must be separated from general waste, placed in different collection bins, collected by a separate fleet of vehicles, and processed independently from general waste.

Recently, the same process has been used for compostable refuse such as yard waste and organics. These items also must be separately collected and processed. In some cases, all compostable materials can be combined for purposes of collection and processing, however, this solution produces inefficiencies. Because organics can contain pathogens, they must be processed to a higher standard than yard waste, which does not include pathogens. Combining yard waste and organics requires the yard waste to receive unnecessary processing.

Of course, the yard waste and organics can be separated at the point of collection, but this requires separate bins, and separate collection vehicles. In some cases, the homeowner would need four separate bins (one for organics, yard waste, recyclables, and general waste). Waste collectors would need four separate vehicles to collect the waste. The inefficiencies in the scheme quickly outweigh any environmental advantages gained from separation.

An additional problem encountered in waste processing is that it is difficult, if not impossible, to track the waste on a granular enough scale to tell if the various processing programs are being used at all, and if so whether they are used efficiently. For example, in most cases collection routes are automated, whereby a collection vehicle mechanically picks up the bins and dumps the refuse without any human intervention. Thus, it is no longer possible to monitor how much waste, and what types of waste, is being processed.

Thus, a need exists for more efficient method of collecting and processing waste, and one that can account for usage.

SUMMARY OF THE INVENTION

One object of some embodiments of the invention is to provide an improved apparatus and method for a more efficient method of collecting and processing waste, and one that can account for usage.

In accordance with a preferred embodiment of the invention, there is disclosed an improved method of waste collection and processing especially useful in the collection and processing of organic waste.

DETAILED DESCRIPTION OF THE PREFERRED EMBODIMENTS

Figure 1:
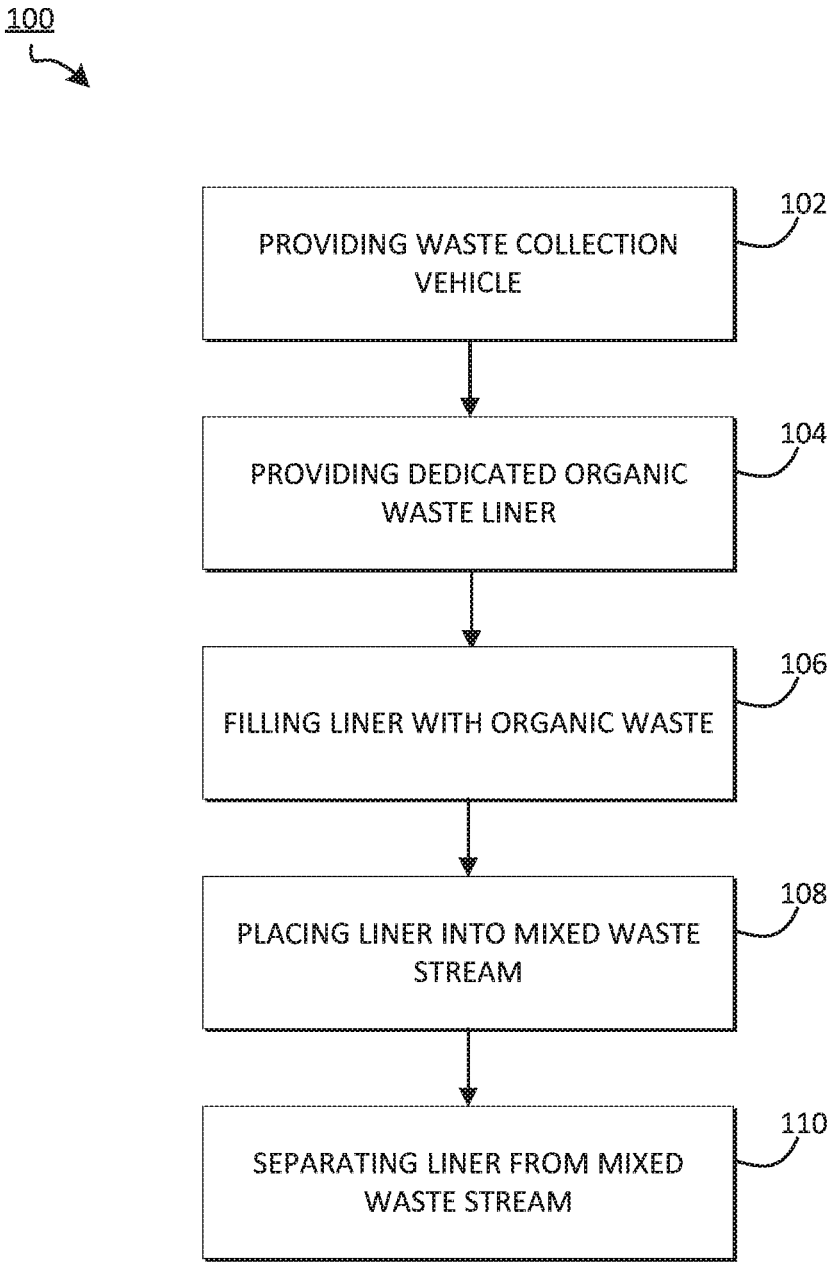
FIG. 1 illustrates an example method of collecting and processing organic waste material.

The present invention utilizes a uniquely configured waste can liner for the purpose of disposing of organic biodegradable waste materials. Examples of organics include fruits and vegetables (rinds and peels), meat, poultry, seafood, eggshells, rice, beans, cheese, bones (bone meal), waxed cardboard products, frozen/refrigerated food boxes, napkins, paper towels, paper plates, milk cartons, tea bags, coffee grounds and filters, parchment and waxed papers, hair (pet hair), and the like. Yard waste, plant, and flower materials are also generally considered organic/compostable materials, but as described below they can be treated differently under the method of the present invention.

The waste can liner of the present invention is specially and uniquely designed as a receptacle for the foregoing organic materials. One unique feature of the can liner is that is colored conspicuously and in a hue that is not common for waste or trash can liners to make it easily identifiable. Blue is one such color that is easy to spot and is not commonly used, making the can liners readably identifiable from the rest of the material in the waste stream, other conspicuous colors can also be used.

The can liner can also be equipped with an embedded identifier that would allow for automated identification of the can liner. Identifiers can include RFID tags, bar codes, or other scanable or readable identifiers. The identifier can be placed in the can liner, or embedded within the material of the can liner, or adhered to the outside of the can liner. Preferably the identifier would be placed in a manner where it remains fixed during the waste collection and separation process, and most preferably where it can be removed and reused or recycled at the end of the process.

The can liners would also preferably be comprised of a material that is suitable to the task for which the can liners are intended. The can liners must be strong enough to resist tearing, be flexible, and would need to withstand compaction. Thus, the thickness should be suitable and preferably in the range of about 1.4 to about 1.57. The can liner should also be biodegradable. Suitable materials include bioplastics, and the like.

The method of the present invention is carried out in the following manner. The can liners of the present invention would be distributed to the customers on one or more conventional manners. For example, the can liners could be provided by the waste removal company periodically as they pick up waste. The can liners could be purchased from retail establishments, or ordered online. Most preferably, the can liners will either be delivered by the hauler when setting up a new account, or at program renewal anniversaries the can liners would be delivered to the customer's home by mail or common carrier. The program can also include specialized cans to be used with the can liners that can be similarly provided.

The consumer would then fill the can liners with organic material until the can liner is full or otherwise ready for disposal, and then dispose of the can liner in the same receptacle as the general trash and waste. There would be no need to segregate the can liner from other types of trash. The waste, including the compostable bag with the organic waste, is then picked up by the carrier in the normal manner.

In one embodiment of the invention, the can liners are tagged with an identifier. In this case the identifier can be scanned or read at the point of pickup. This can be done by automated devices such as RFID reader, barcode reader, or the like. Preferably, the reader would be located on the waste collection vehicle in a position where it can read the identifier as the waste is deposited into the vehicle.

Another feature that can take place at this time is recording the geographic location of the vehicle at the time the identifier reads the can liner identifier. This allows for correlation of a particular customer with their organic waste. The geolocation information can be recorded with a GPS type device. Alternatively, it would not be necessary to use a geolocation device if the can liners are ordered and delivered to the customer by the waste collection company. In that case, the company would already be able to correlate can liners with customers using the identifiers, and it would only be necessary to read the identifier at the time of collection (or it can be done at a later point in time).

At some point after collection, the bagged organic material needs to be separated from the rest of the waste. Separation can take place at any place where the waste would require some processing normally, such as a transfer station or at the landfill itself. Separation is possible because of the distinctive color of the can liners. In addition, the identifier can be used assist in the process of locating the organic can liners. Furthermore, in the case where the identifier has been previously correlated to location it is possible to scan the can liners at the point of separation rather than at the point of collection.

FIG. 1 illustrates an example method 100 of collecting and processing organic waste material. The example method 100 includes block 102, which recites "providing waste collection vehicle." The example method 100 further includes block 104, which recites "providing dedicated organic waste liner." The example method 100 further includes block 106, which recites "filling liner with organic waste." The example method 100 further includes block 108, which recites "placing liner into mixed waste stream." The example method 100 further includes block 110, which recites "separating liner from mixed waste stream."

In this manner, the present invention substantially overcomes the problems of the prior art. Organic waste can be collected without segregation from the general waste stream, which eliminates the need for separate containers to store the waste prior to collection, and the need for a separate fleet of vehicles to collect the waste that provides substantial environmental benefits as well as substantially reduced equipment costs for the hauler. In addition, organic material can be separated from yard waste, which reduces unnecessary processing of yard waste. It would no longer be necessary to process yard waste for pathogen elimination.

The ability to associate organic waste with a customer, though the use of identifiers and scanners provides additional advantages. It provides the ability to track how well the program is being used by tracking a customer's usage. It can also be used to determine when a customer needs to reorder can liners, and trigger automatic delivery of additional can liners. It can be used for billing purposes, if a per can liner fee is charged. It can also be used to identify customers that are not placing the correct waste in the can liners.

The present invention is particularly adapted for commercial use. Commercial entities frequently do not participate in organic and/or yard waste recycling because of the physical limitations such programs impose. Commercial customers typically only have room for one bin or dumpster and cannot physically accommodate additional bins/dumpsters. The present invention accommodates commercial needs by allowing for segregation or organics without introduction of separate containers.

Additionally, the organic materials can be co-collected with regular landfill waste or co-collected with yard waste. In the latter case, the yard waste and organics can be separated and collected in the same stream, but separate from landfill waste. Or, as stated above organics can be collected with general landfill waste and may, or may not include yard waste.

While the preferred embodiment of the invention has been described in reference to the foregoing disclosure, the invention is not so limited.

Unless otherwise defined, all technical and scientific terms used herein have the same meaning as commonly understood by one of ordinary skill in the art to which this invention belongs. Although methods and materials similar to or equivalent to those described herein can be used in the practice or testing of the present invention, suitable methods, and materials are described below. All publications, patent applications, patents, and other references mentioned herein are incorporated by reference in their entirety to the extent allowed by applicable law and regulations. In case of conflict, the present specification, including definitions, will control.

The present invention may be embodied in other specific forms without departing from the spirit or essential attributes thereof, and it is therefore desired that the present embodiment be considered in all respects as illustrative and not restrictive, reference being made to the appended claims rather than to the foregoing description to indicate the scope of the invention. Those of ordinary skill in the art that have the disclosure before them will be able to make modifications and variations therein without departing from the scope of the invention.

The invention claimed is:

1. A method of collecting and processing compostable, organic waste material within a mixed waste stream, comprising:

using a waste collection vehicle to collect from each of a plurality of homeowners general waste and a liner containing compostable, organic waste, wherein the liner is adapted to be separated from the mixed waste stream by being formed of a material that is flexible, resistant to tearing, and capable of withstanding compaction such that the liner does not break open in the waste collection vehicle;

wherein for each homeowner, the general waste and the liner containing the compostable, organic waste are together contained within a single receptacle and the receptacle is emptied into the waste collection vehicle such that the liner containing the compostable, organic waste and the general waste are added to the mixed waste stream;

using the waste collection vehicle to transport the collected waste to a separation location; and separating the liners containing the compostable, organic waste from the mixed waste stream at the separation location.

2. The method of claim 1, wherein the liner comprises a scannable identifier embedded within the material of the liner, and wherein the step of separating further comprises automatically identifying the liner by scanning the scannable identifier within the embedded material of the liner.

3. The method of claim 1, wherein the separation location is a waste processing facility.

4. The method of claim 1, wherein the separation location is a transfer station.

5. The method of claim 1, wherein the separation location is a landfill.

6. The method of claim 1, wherein the liner is biodegradable.

7. The method of claim 1, wherein the liner is colored conspicuously enabling identification and separation of the liner from the general waste in the mixed waste stream.

8. The method of claim 7, wherein the liner is blue.

* * * * *